US006314579B1

(12) United States Patent
Marcon

(10) Patent No.: US 6,314,579 B1
(45) Date of Patent: Nov. 13, 2001

(54) PERSONAL SURVIVAL VESTPAC

(76) Inventor: Pamela Leigh Marcon, 2500 N. 2nd. Rd., Arlington, VA (US) 22201

( * ) Notice: Subject to any disclaimer, the term of this patent is extended or adjusted under 35 U.S.C. 154(b) by 32 days.

(21) Appl. No.: 09/756,752

(22) Filed: Jan. 10, 2001

Related U.S. Application Data

(60) Provisional application No. 60/175,633, filed on Jan. 12, 2000.

(51) Int. Cl.[7] ..... A41D 1/04
(52) U.S. Cl. ..... 2/102
(58) Field of Search ..... 2/102, 69, 94, 2/462, 463, 467, 247, 84, 468, DIG. 3

(56) References Cited

U.S. PATENT DOCUMENTS

| | | |
|---|---|---|
| 1,292,587 | 1/1919 | Delre . |
| 2,607,934 | 8/1952 | Bailhe . |
| 2,702,386 | 2/1955 | Johnson . |
| 2,911,649 | 11/1959 | Ruelle et al. . |
| 3,266,070 | 8/1966 | O'Link . |
| 4,416,641 | 11/1983 | Spinosa et al. . |
| 4,669,127 | 6/1987 | Swanson . |
| 4,673,366 | 6/1987 | Hawkins . |
| 4,864,656 | 9/1989 | Nesse . |
| 5,014,359 | 5/1991 | Hanson . |
| 5,247,707 | 9/1993 | Parker et al. . |
| 5,361,412 | 11/1994 | Perry . |
| 5,584,737 | 12/1996 | Luhtala . |
| 5,603,646 | 2/1997 | Tobias . |

*Primary Examiner*—Gloria M. Hale
*Assistant Examiner*—Tejash Patel

(57) ABSTRACT

An emergency survival Vestpac apparatus for emergency preparedness including a front and a back, each of which includes reflector pockets for receiving and holding emergency supplies to sustain the wearer during an emergency event. The detachable padded hood holds two space blankets and offers protection. The detachable neck guard includes a space suit, the detachable backpack includes an insertable survival pack, the lower portion of the backpack serves as a roll out shelter, and the enclosed harness belt with hooks on each end of the belt encircles the waist for securing the wearer to a stable object or to assist with air rescue. The Vestpac may be appropriately sized to the wearer.

1 Claim, 1 Drawing Sheet

PERSONAL SURVIVAL VESTPAC

This application claims benefit of Provisional No. 60/175,633 filed Jan. 12, 2000.

BACKGROUND OF THE INVENTION

1. Field of the Invention

The present invention relates generally to the field of clothing designed for survival during disaster and more particularly to the field of emergencies during flash floods, tornados, earthquakes, hurricanes, blizzards, fires, shelter evacuation, camping, boat and car trips. More specially, it relates to a waterproof fire resistant, reflectorized floatation vest and detachable back pack with an insertable tri-fold survival pack when removed and unfolded can be used to carry a cell phone or satellite phone, survival gear, and supplies. The multiple compartments and pockets contain a myriad of items allowing adults, children, and pets to survive a natural disaster, to endure the immediate aftermath and contribute to being rescued.

2. Description of Background Art

Many different types of survival or emergency preparedness vests have been developed through the years and designed for a specific purpose. For example, there have been vests designed with pockets and backpacks for first aid kits, food items, and different supplies useful in an emergency situation by a lost hiker or hunter or stranded fisherman or downed airplane pilot.

Recent acts of nature, such as floods, hurricanes, earthquakes, fires, and tornadoes have demonstrated that practicality of being prepared for such unexpected emergencies. A period of 72 hours or three-day period includes providing the basic needs of shelter, food and water, and clothing.

The present invention comprises a vest with a detachable padded hood with neck guard and a backpack which is tailored to fit an adult male, an adult female, or a child to allow the individual to provide in a single garment communication capabilities, food shelter,water and purifying tablets, clothing, and other emergency supplies to sustain a person for a period of three days or seventy-two hours as referred to above.

U.S. Pat. No. 1,292,587 (D. Del Re) disclosed a life preserver with one or more waterproof pockets having contractible mouths for carrying valuables. The garment also includes floatation capabilities with an attached waterproof bag.

U.S.Pat. No. 2,607,934 (G. Bailhe) disclosed a life saving garment with an attachable over garment which is readily inflatable with two front side pockets and chest pockets.

U.S.Pat. No. 2,702,386 (G. Johnson) disclosed a suit for fire and water safety constructed of fireproof and waterproof material with a rigid collar and hood, and a removable buoyancy belt constructed of waterproof material.

U.S. Pat. No. 2,911,649 (P. F. Ruelle et al) disclosed a survival protective waterproof garment covering the entire body that can be folded up when not used into a knapsack. This garment provides warmth and protects the entire body from water.

U.S. Pat. No. 3,266,070 (M. H. O'Link) disclosed an inflatable garment with removable inflatable members and has usefulness as a non-inflatable garment. The outer chest panel of the garment has a plurality of pockets on the right side panel and on the left side panel.

U.S. Pat. No. 4,416,541 (Spinosa et al) disclosed a jacket for covering the torso, arms, and removable crotch with insulated fire resistant material, a removable inflatable bladder for survival from exposure to natures elements.

U.S. Pat. No. 4,669,127 (Swanson) disclosed a utility vest shaped garment with load carrying compartments on the back and front flaps of the vest.

U.S. Pat. No. 4,673,366 (Hawkins) disclosed a suit with an attached inflatable life jacket with hood.

U.S. Pat. No. 4,864,656 (Nesse) disclosed a jacket/vest with a life preserver that functioned as a floatation device.

U.S. Pat. No. 5,014,359 (Hanson) disclosed a vest and backpack for carrying equipment for fishing, hiking,hunting, and camping.

U.S. Pat. No. 5,247,707 (Parker et al) disclosed a utility vest with a number of pockets and on the rear of vest one of the pockets contained a folded backpack.

U.S. Pat. No. 5,361,412 (Perry) disclosed an emergency preparedness vest with a plurality of pockets for emergency survival equipment and supplies.

U.S. Pat. No. 5,584,717 (Luhtala) disclosed a versatile safety garment which can be worn as a regular garment serving as a flotation device when needed and easily converted to a bullet/fragment-proof garment.

U.S. Pat. No. 5,603,646 (Tobias) disclosed a protective jacket including a waterproof hidden inflatable vest, an emergency inflatable bladder, detachable sleeves, and a storm collar. The jacket in vest mode stores a hood in the zippered collar enclosure.

The garment of the present invention includes both interior and exterior reflector pockets for carrying different emergency supplies and equipment and the garment is substantially different from the structure of the patents discussed above.

SUMMARY OF INVENTION

The present invention defined and claimed herein comprises a vest apparatus having a plurality of reflective pockets covering the garment for receiving different types of emergency supplies, including a thermal suit, gloves high tensile nylon rope, storage for a hood and neck guard and further comprising a detachable backpack with compartments for space blankets, a high tech one man shelter, a cellular phone or satellite phone, emergency numbers, a GPS and/or Marine Beacon radio, a flashlight, maps, extra batteries, a first aid kit, a compass, flares, candles, waterproof matches, a multifunctional tool (Swiss Army Knife) mace, insect repellent, medic alert tags, nutritionally dense high protein food bars, water and purifying tablets, and personal items such as identification and money.

It is the object of the invention to provide an emergency pack to facilitate escape, short term survival, and rescue during and immediately following a natural disaster.

It is further an object of the invention to have a life vest with a backpack and harness for floatation and survival providing protection to the upper body during storms and floods.

It is yet a further object of the invention to provide an adult vestpac weighing less than ten (10) pounds without personal items but containing food and water for three days or seventy-two hours.

It is further an object of the invention to have garments for children without the full technical gear and weighing less.

It is yet further object of this invention to have pet units comprising shelter, food. water and compartments for identification, leashes and medication with the contents be adaptable to regional and seasonal needs.

It is an object of the invention to provide improved survival and emergency needs in a garment for the purposes described above which is dependable, inexpensive, convenient, and highly effective in accomplishing it's intended purpose.

These and other objects of the present invention will become more apparent in a further review of the Specification and the drawing.

DESCRIPTION OF THE PREFERRED EMBODIMENT

Figure 1:
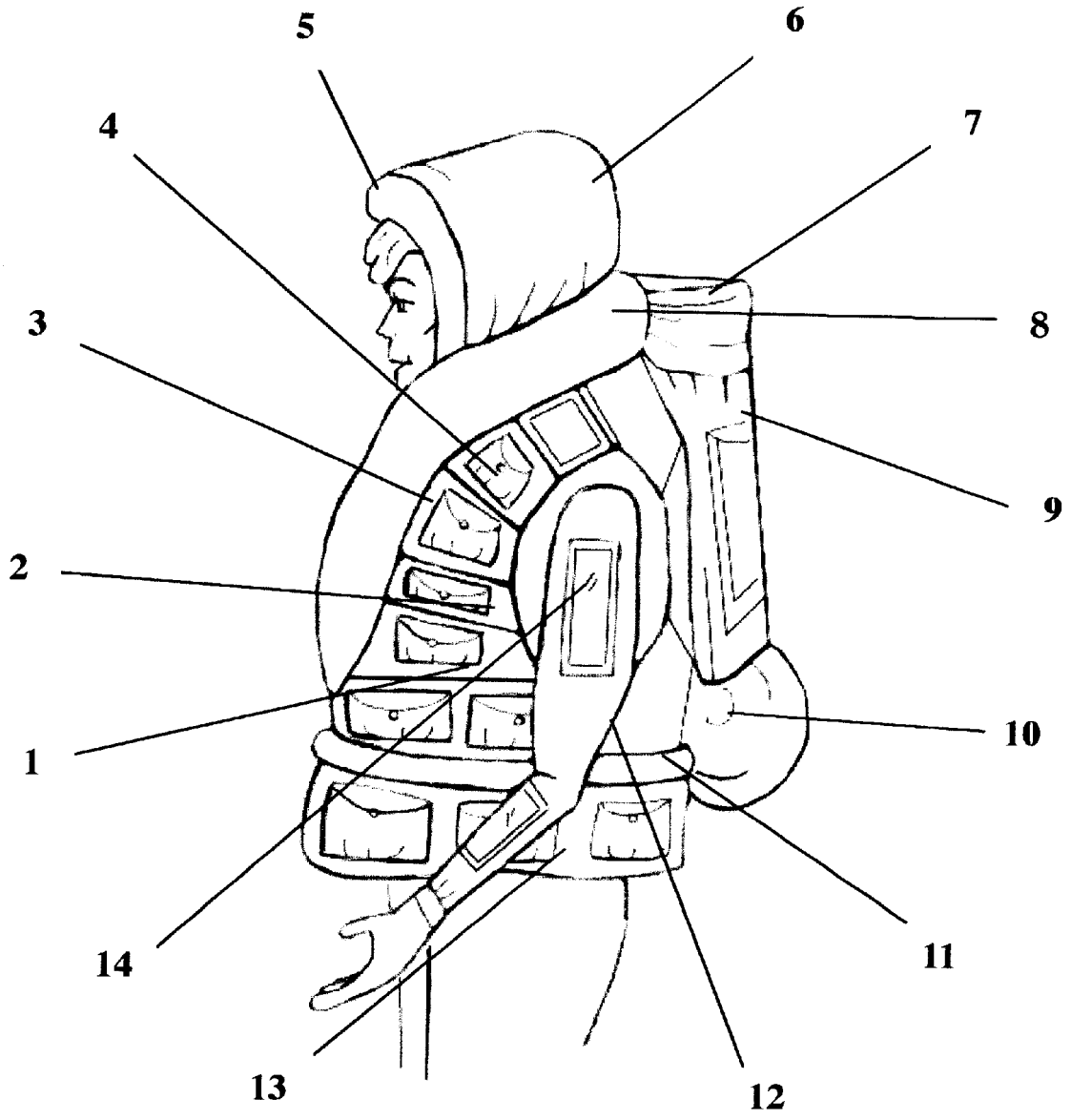
FIG. 1 is a perspective view of the garment apparatus of the present invention

FIG. 1 is a view of the Personal Survival Vestpac apparatus 2 The Vestpac apparatus 2 includes two layers of material. The layers of material include an outer layer 3 and an inner floatation insulated padded layer 4 a plurality of reflector pockets 1 are appropriately secured to the outer layer 3 and to the inner layer 4 The purpose of the reflector pockets will be discussed below.

Both the outer layer 3 and the inner layer 4 are made of strong, lightweight, waterproof and fire proof material. The inner layer 4 may be made of a lighter material.

As can be seen from FIG. 1 the vestpac apparatus extends down the front, the back, the right side, and the left side covering the upper body of the wearer. The outer layer 3 has a plurality of reflector pockets fastened and secured by stitching to both the front portion 1 and to the back of 12.

The detachable protective padded hood front 5 and the padded hood back 6 conceals two space blankets.

The protective detachable neck guard 8 used as protection from flying debris includes and enclosed space suit.

The rear portion of the apparatus has a detachable survival backpack with an out covering or shell 7 with a survival pack insert 9 The survival backpack has a rollout shelter 10 enclosed in the lower portion.

A covered harness 11 back rear portion with two metal hooks, one on each end of the apparatus and front covered harness 13 encircles the waist to be used for stabilizing a person or for air rescue.

The front portion 4 includes pockets 14 secured to the out layer 3 as by stitching. The pockets are zippered with waterproof lining. These pockets are for carrying a map, compass, money, identification (dog Tags), a cellular phone or satellite phone, a thermal suit, gloves, nylon tensile rope, and other valuables.

The bottom row of pockets on the front portion 1 is an oversized pouch pocket for water and purifying tablets. The pocket is closed by a zipper and has a waterproof lining. The pocket is secured by stitching with reflector stitched to outer portion.

It will be up to the individual user of the Vpac 2 apparatus as to what supplies are placed into pockets.

The backpack 10 serves as the covering for the insertable survival pack 9 including GPS and/or Marine Beacon radio, flashlight, extra batteries, first aid kit, flares, candies, waterproof matches, multifunctional tool (SWISS ARMY KNIFE) mace, insect repellent, and food (energy bars and jerky).

The bottom portion 10 of the backpack includes a rollout shelter that may be disposed as needed.

It is obvious that the survival Vestpac apparatus may be made in various sizes to accommodate the various size of users. Moreover it will be obvious that for use by children the size and the number of pockets on the outer layer 3 may vary. The survival Vpac apparatus is designed to be flexible and to yet provide a user with sufficient pockets and storage space for carrying the needed necessities of life for emergency period of three days or seventy-two hours.

The principles of the invention have been made clear in the illustrative embodiments, there will obviously be those skilled in the art of emergency survival apparatuses many modifications of the proportions, the materials, the supplies, the arrangement, and the components used in the invention, and which are especially adapted to specific environments and emergency conditions and operative requirements without departing from the spirit and the scope of the principles or the claim. The appended claim is intended to cover any and all such modifications within the spirit and the scope of the invention.

What is claimed is:

1. An inflatable and protective survival vest pack comprising in combination, a vest having a body portion adapted for the human torso including back and front panels, an inflated detachable hood portion adapted to cover the head and a detachable neck guard portion adapted to extend around the back and sides of the wearers neck with the back panel having a detachable backpack attached thereto, further, the body portion includes at least six zippered utility pockets with reflectors connected on an outer portion thereof and wherein said pockets are positioned on an exterior surface of the front and back panels, the inflatable detachable hood portion is secured around a neck opening as an extension from the detachable neck guard, the neck guard is secured around the neck opening as extension from a vertically extending front opening, fastening means allow the front opening to be selectively opened or closed, the detachable backpack having a waterproof impervious lining includes an insertable trifold survival pack therewith in which has at least eight zippered pockets on a left interior fold and at least nine zippered pockets on a right inner fold with a center portion formed therebetween, and a roll-out shelter is concealed in a lower portion of the backpack.

* * * * *